United States Patent [19]

Dvorsky et al.

[11] 4,196,816

[45] Apr. 8, 1980

[54] HEAVY DUTY CRANE

[75] Inventors: James R. Dvorsky; Robert J. Vrba, both of Cedar Rapids, Iowa

[73] Assignee: FMC Corporation, San Jose, Calif.

[21] Appl. No.: 847,639

[22] Filed: Nov. 1, 1977

[51] Int. Cl.[2] ..... B66C 23/72

[52] U.S. Cl. ..... 212/49; 212/145

[58] Field of Search ..... 212/28, 48, 49, 66–70, 212/144, 145

[56] References Cited

U.S. PATENT DOCUMENTS

| | | | |
|---|---|---|---|
| 3,485,383 | 12/1969 | Beduhn | 212/48 |
| 3,878,944 | 4/1975 | Beduhn et al. | 212/145 |
| 3,955,684 | 5/1976 | Novotny | 212/48 |
| 4,042,115 | 8/1977 | Beduhn et al. | 212/28 X |

FOREIGN PATENT DOCUMENTS

| | | | |
|---|---|---|---|
| 1185353 | 1/1965 | Fed. Rep. of Germany | 212/28 |

*Primary Examiner*—Albert J. Makay
*Attorney, Agent, or Firm*—J. F. Verhoeven

[57] ABSTRACT

A crane is operable in either a regular mode or a heavy duty mode. In the regular mode, an upper works is rotatble, through a turntable bearing, on a lower works. A boom is pivotally connected to one end of the upper works and a counterweight is connected to the opposite end thereof. In the heavy duty mode, a support ring surrounds the lower works and is connected thereto. An auxiliary frame is mounted on the support ring, surrounding the upper works, for rotation on the ring in unison with rotation of the upper works. The boom used in the regular mode is pivotally connected to the auxiliary frame for use as a gantry, and a heavier boom is pivotally connected to the auxiliary frame adjacent the gantry. The counterweight of the machine in the regular mode is shifted to the auxiliary frame opposite the boom and gantry, and an auxiliary counterweight is added to the auxiliary frame.

10 Claims, 10 Drawing Figures

HEAVY DUTY CRANE

BACKGROUND OF THE INVENTION

1. Field of the Invention

The present invention relates to cranes, and, more particularly, to heavy duty cranes for lifting heavy loads.

A conventional crane has a lower works, and an upper works which is mounted, through a turntable bearing, for rotation on the lower works. A boom is pivotally connected to one end of the upper works, and a counterweight is secured to the other end of the upper works. In this type of crane, the weight of the load, and the weight of the counterweight, must be transmitted to the lower works (and the ground) through the turntable bearing. Consequently, the load which can be lifted by the crane is limited to a load which can be supported by the upper works without damage to the turntable bearing, and/or without exceeding a safe margin on overturning.

2. Description of the Prior Art

Many efforts have been made in the past to transfer the load carried by the boom, and/or the weight of the counterweight, around (instead of through) the turntable bearing.

The United States patent to Holt No. 1,159,841 shows an upper works (or swing frame) rotatably mounted on a lower works (or main frame). A boom is mounted at one end of the upper works, and a heavy prime mover (which acts to counterbalance the load) is mounted at the other end of the upper works. A pair of slide blocks is mounted under the prime mover, between the upper works and the lower works to partially support the load imposed on the upper works and transfer that load to the lower works.

The United States patent to Scheuerpflug No. 2,910,189 shows an upper works mounted for rotation on a lower works. A boom is pivotally mounted on an intermediate member which, in turn, is pivotally connected to the upper works. The intermediate member rolls on a way on the lower works to transmit the load of the boom directly to the lower works (and around the upper works).

The Netherlands Pat. No. 6,405,689 shows an upper works mounted on a lower works wherein the boom is mounted on a separate wheeled vehicle for transmission of the load directly to the ground.

The United States patent to Beduhn No. 3,485,383 shows a crane with an upper works mounted for rotation on a lower works. An auxiliary support ring mounted on the ground surrounds the lower works, and supports one end of a carrier which is pivotally connected to the upper works. A boom is mounted on the end of the carrier supported by the ring to transfer the load of the boom through the support ring to the ground. The machine has two counterweights, one permanently mounted on the upper works and one slidably mounted on the upper works but supported by the support ring.

SUMMARY OF THE PRESENT INVENTION

In the machine of the present invention, a counterbalanced auxiliary frame has been provided to transfer the weight of the load and the counterweight to the ground without transmission through the turntable bearing.

In the machine of the present invention, an upper works is rotatably mounted, through a turntable bearing, on a lower works. The upper works, the turntable bearing, and the lower works may be used as a regular duty crane. In addition, however, when large loads must be lifted, a circular support is mounted on the ground to encircle the lower works. The counterbalanced auxiliary frame is mounted on the circular support for rotation thereon in unison with rotation of the upper works. The counterbalancing forces on the auxiliary frame comprise the boom, pivotally connected to one end, and an auxiliary counterweight mounted at the opposite end. The upper works has a counterweight which is used when the crane is operated as a regular duty crane, but when heavier loads are to be lifted, the upper works counterweight may, in one form of the invention, be transferred to the auxiliary frame to assist the auxiliary counterweight in counterbalancing the weight of the load carried by the boom. The full weight of the counterbalanced auxiliary frame (that is, the weight of the auxiliary frame itself, the weight of the boom and the load carried thereby, and the weight of the auxiliary counterweight and/or the upper works counterweight) is transferred directly to the ground without imposing the load on the turntable bearing.

In the mechanism of the present invention, the auxiliary counterweight need not be mounted directly over the circular support, but can instead be positioned in any desired position (relative to the circular support) opposite the boom to create the desired counterbalance for the boom (and the design load to be carried thereby).

It is therefore one object of the present invention to provide a crane capable of heavy duty lifting in which the load is carried by a counterbalanced auxiliary frame.

It is another object of the present invention to provide a crane in which the force of the load and the gravitational force of the counterweights is transferred through a counterbalanced auxiliary frame directly to the ground and not through the turntable bearing.

It is yet another object of the present invention to provide a crane in which the gravitational force of all counterweights can be transferred from the upper works turntable bearing to a counterbalanced auxiliary frame.

DESCRIPTION OF THE PREFERRED EMBODIMENT

Figure 1:
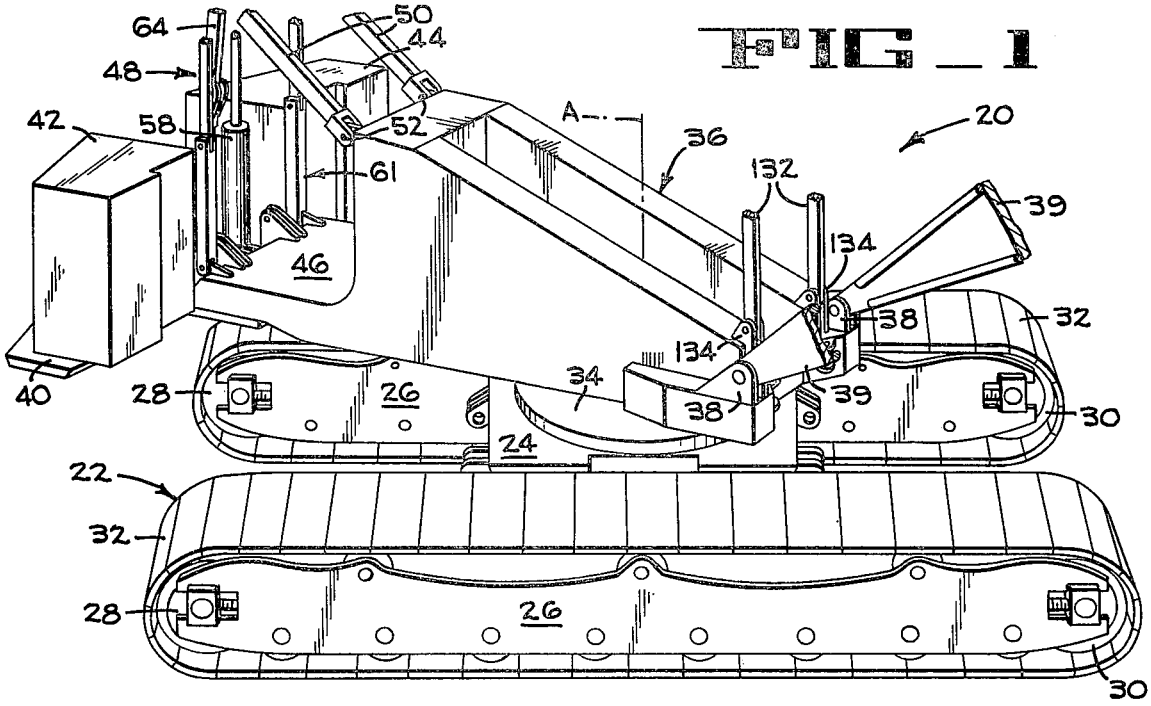
FIG. 1 is a view in perspective of parts of the crane of the present invention assembled for use as a regular duty crane, with parts omitted for clarity.
Figure 2:
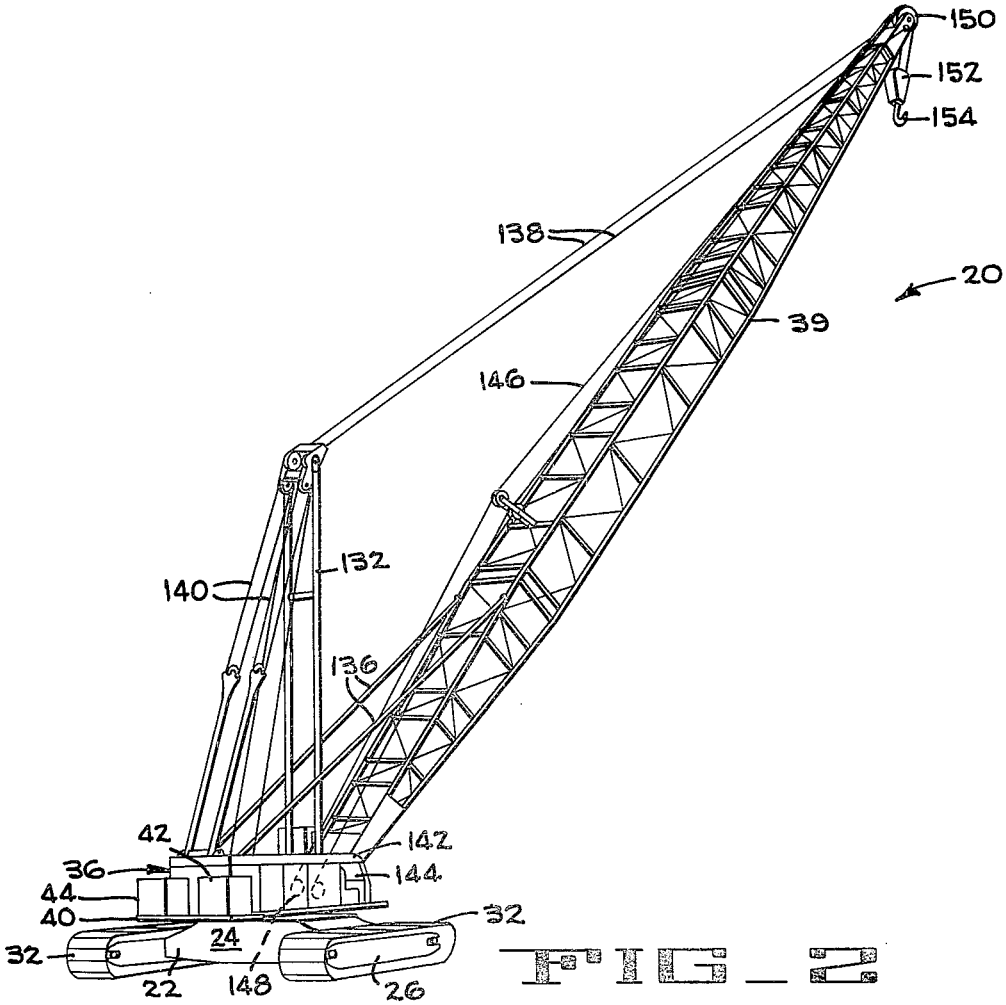
FIG. 2 is another view in perspective of parts of the crane of the present invention for use as a regular duty crane.

The heavy duty crane of the present invention is made up of an assembly of parts (to be described hereafter), some of which correspond in function to parts of a conventional, regular duty crane. These parts which correspond in function to parts of a regular duty crane may be assembled as a crane for regular duty, as shown in FIGS. 1 and 2. In FIG. 1, parts have been omitted for clarity.

The regular duty crane of FIGS. 1 and 2, identified by the numeral 20, includes a lower works 22 with a central base portion 24 and a pair of side frames 26 connected, respectively, to the sides of the base portion. A pair of sprockets 28 and 30 are rotatably mounted at the ends of the side frame to receive an endless track 32.

A bearing 34 is received in the central base portion 24 to support the upper works 36 of the crane for rotation about a vertical axis A with respect to the lower works. The upper works has brackets 38 at the forward end to receive a boom 39 (see FIG. 2), and has a plate 40 at the rear end to receive counterweights 42 and 44. The plate 40 can be moved up against a rear platform 46 of the upper works by a power lift mechanism 48 mounted on platform 46.

Figure 3:
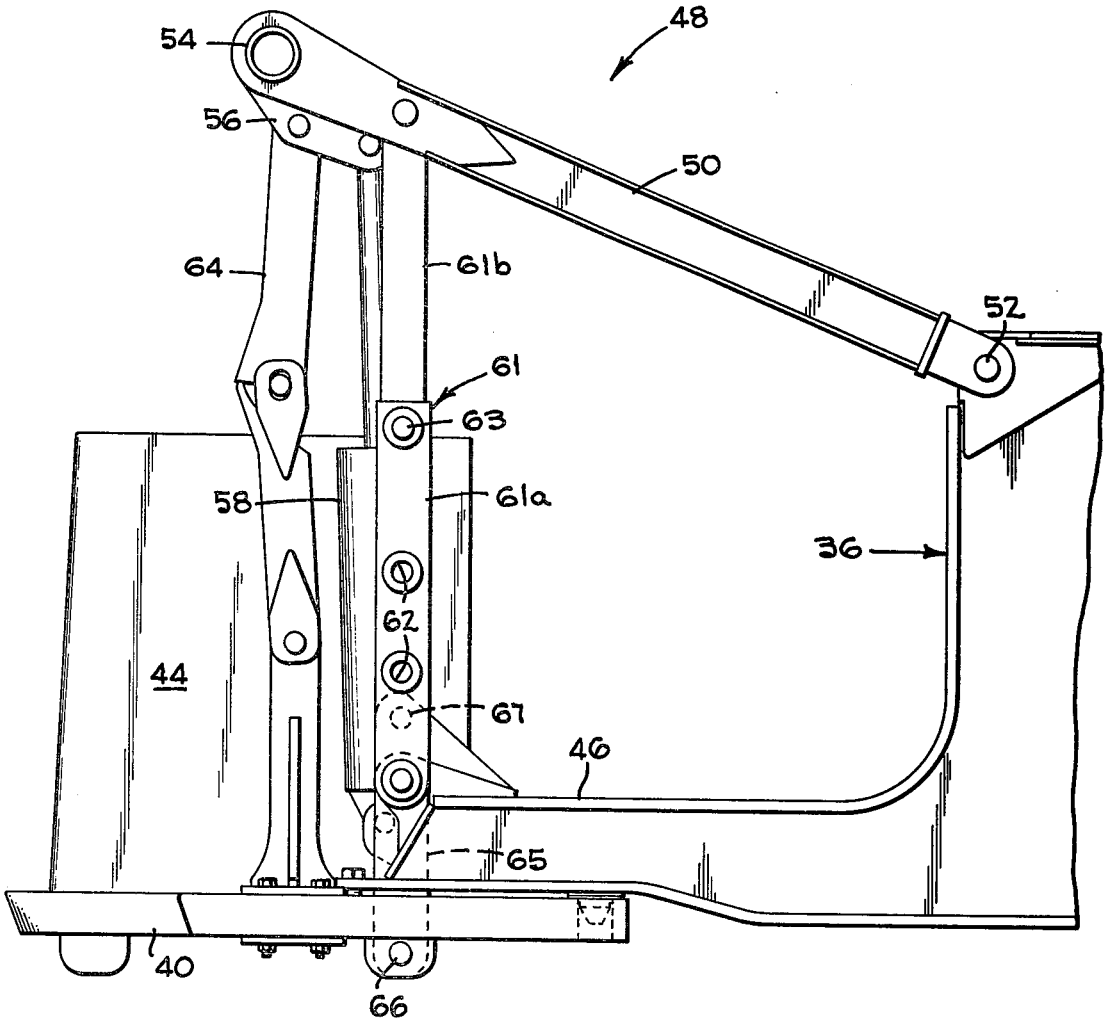
FIG. 3 is a side view of the mechanism for shifting the upper works counterweight off and on the upper works.
Figure 3:
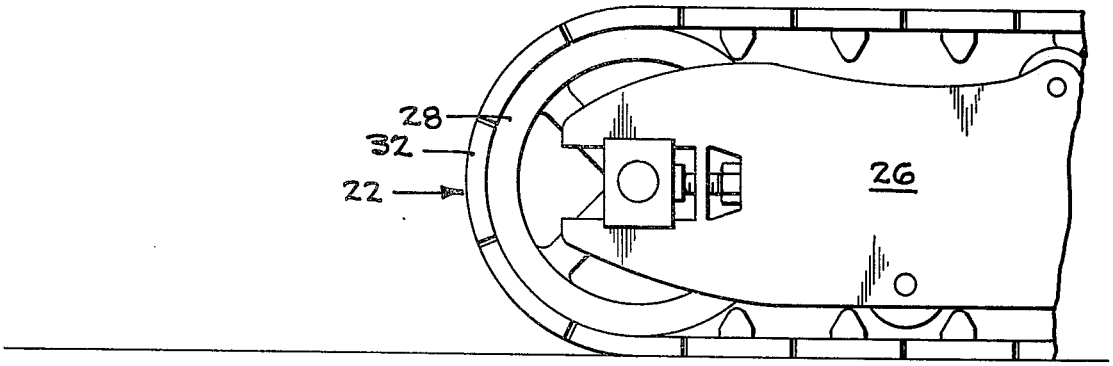
Figure 4:
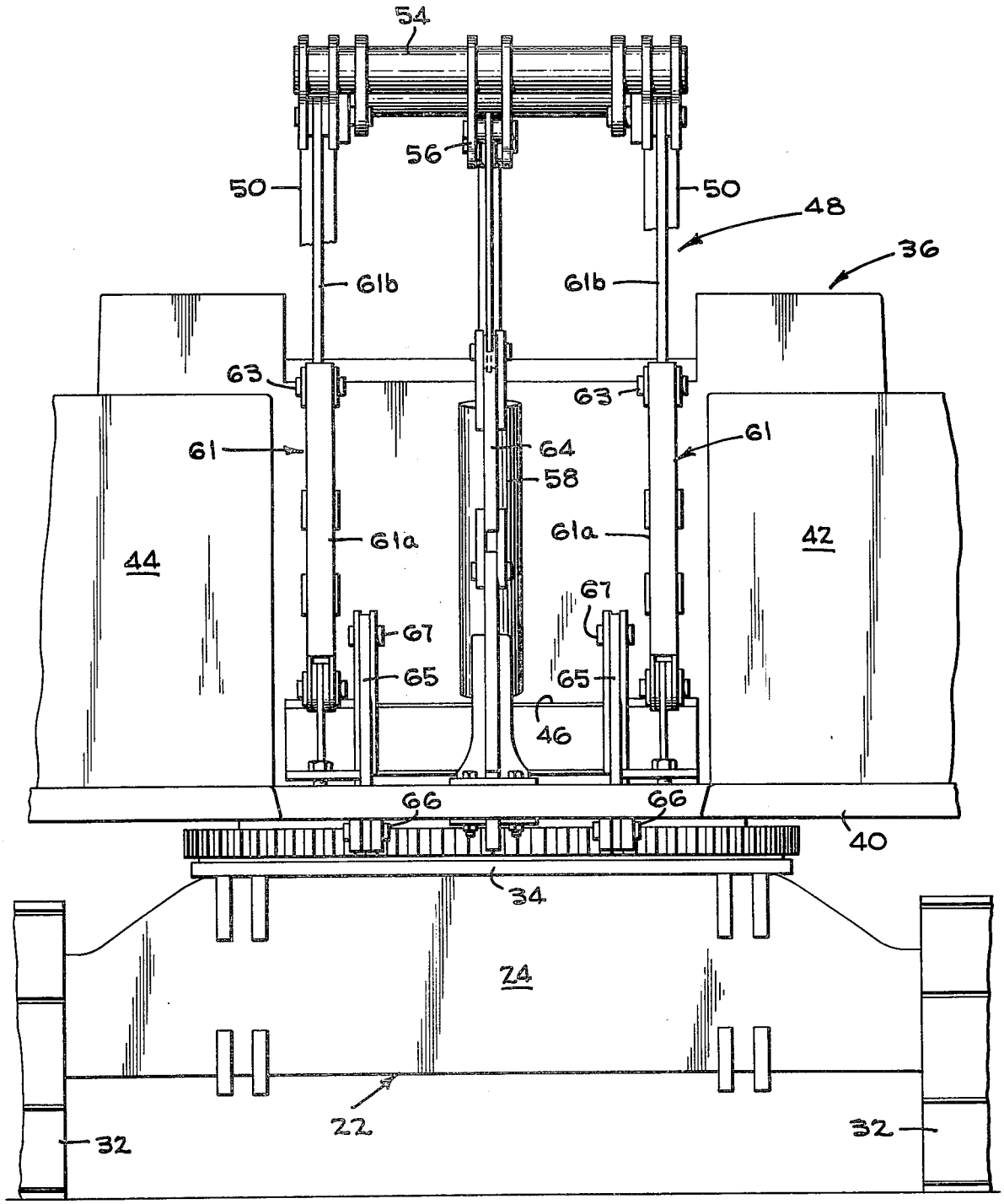
FIG. 4 is an end view of the mechanism of FIG. 3.

The mechanism 48, as shown in FIGS. 3 and 4, includes a pair of arms 50, pivotally connected to the upper works at 52, to extend over platform 46. A cross bar 54 extends between the ends of arms 50 and receives thereon a bracket 56. A ram 58 is pivotally connected at one end to upper works platform 46 and has a piston rod pivotally connected at the opposite end to bracket 56. Thus, as the ram expands, the arms 50 swing upwardly to the position shown in FIGS. 3 and 4, and as the ram contracts, the arms 50 swing downwardly.

A telescopic strut 61 is connected between the outer end of each arm 50 and the upper works platform 46 to support the arms in a selected position. The lower portion 61*a* of the strut has a series of holes 62 into one of which a pin 63 is received, passing through a hole in the upper portion 61*b* of the strut, to lock the arms in a predetermined position.

A foldable leg 64 is connected at the upper end to bracket 56 and at the lower end to plate 40. When the arms 50 are in their uppermost position, the plate 40 (on which counterweights 42 and 44 are mounted) is moved up against the underside of upper works platform 46. Links 65, secured at 66 to the plate 40, are pinned at 67 to the platform 46 to lock the plate 40 to the underside of the platform 46. After the counterweight plate is locked to the upper works, the leg 64 can be folded and the arms 50 lowered until the mechanism 48 is required to shift the upper works counterweights off the upper works for heavy duty loads.

Figure 5:
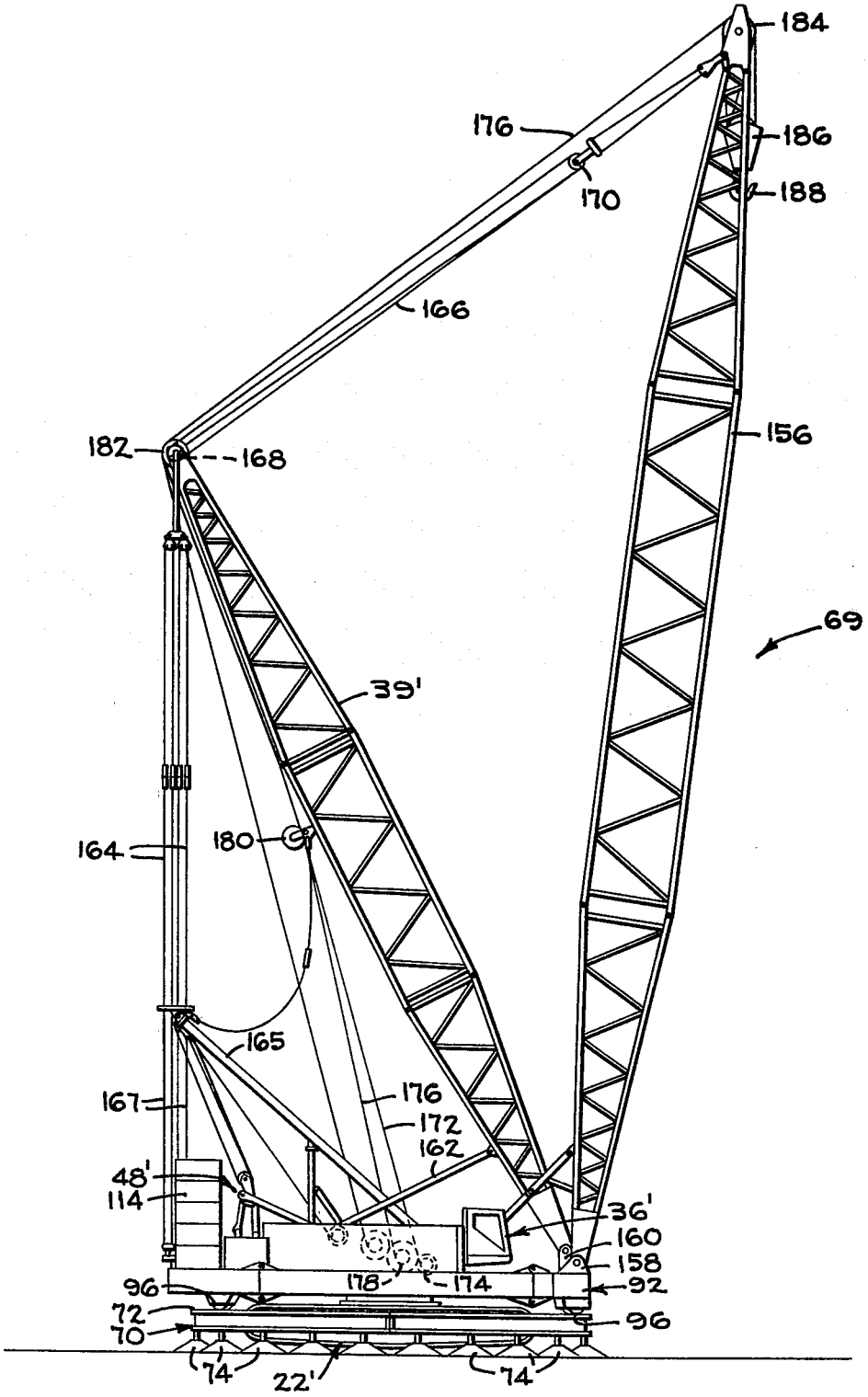
FIG. 5 is a side elevational view of the crane in the heavy duty mode.

The heavy duty crane 69 of the present invention is shown in FIG. 5. For illustrative purposes, all parts of the regular duty crane 20 of FIG. 1 will be incorporated in the heavy duty crane of FIG. 5, and these parts will be identified in the drawing figures of the heavy duty crane by prime numerals corresponding to the numerals by which these parts were identified in the regular duty crane. Parts which are used only in the heavy duty crane will be identified by their own numerals, without any prime.

The heavy duty crane is shown in FIGS. 5 to 10. Many of these figures show only portions of the crane, solely for a better understanding of those portions of the crane which would not be clearly visible if the whole crane were shown in every figure. The particular subassemblies shown in each figure were selected only to show clearly the construction of the crane, and it is not intended that these subassemblies illustrate a preferred method of assembling the crane.

Figure 6:
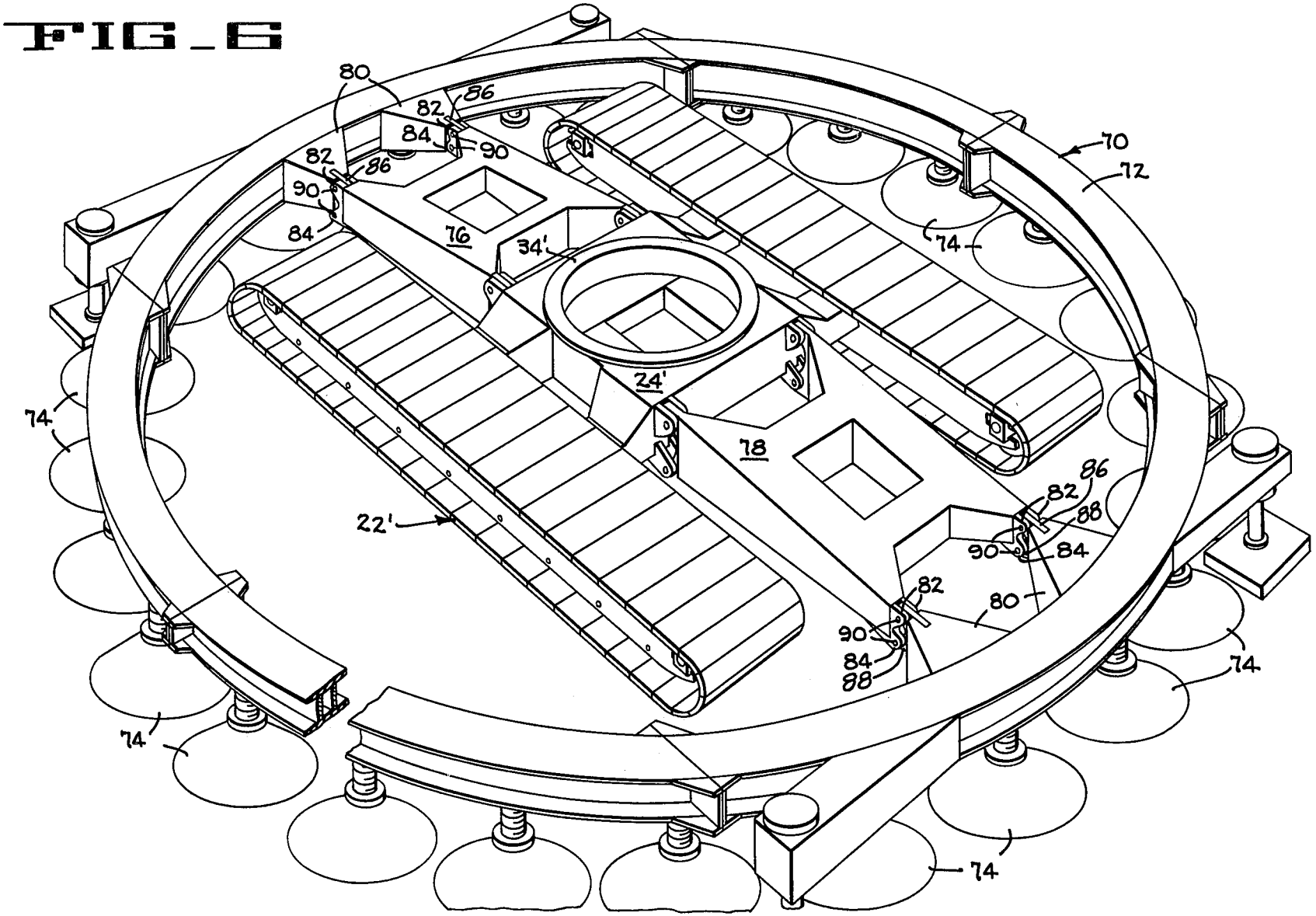
FIG. 6 is a fragmentary view (with parts omitted for clarity) of the lower works of the machine surrounded by the load supporting ring.

A ring 70 (preferably a box section to resist movement), having a flat upper surface 72, surrounds the lower works 22' of the crane as shown in FIG. 6. The ring is supported from the ground by adjustable standards 74 to lie in a generally horizontal plane. The ring 70 is securely connected to the lower works 22' by means of two trusses 76, 78, each of which is connected between the central base portion 24' of the lower works and bosses 80 extending inwardly from the inner surface of the ring. Each end of each truss is connected at each side to the central base portion 24' of the lower works, and a boss 80, by means of an upper and lower clevis 82, 84, in conjunction with an upper and lower ear 86, 88 and horizontal pins 90. Thus, the ring 70 is held securely against rotation or pivoting movement (or horizontal movement) relative to the lower works 22'.

Figure 7:
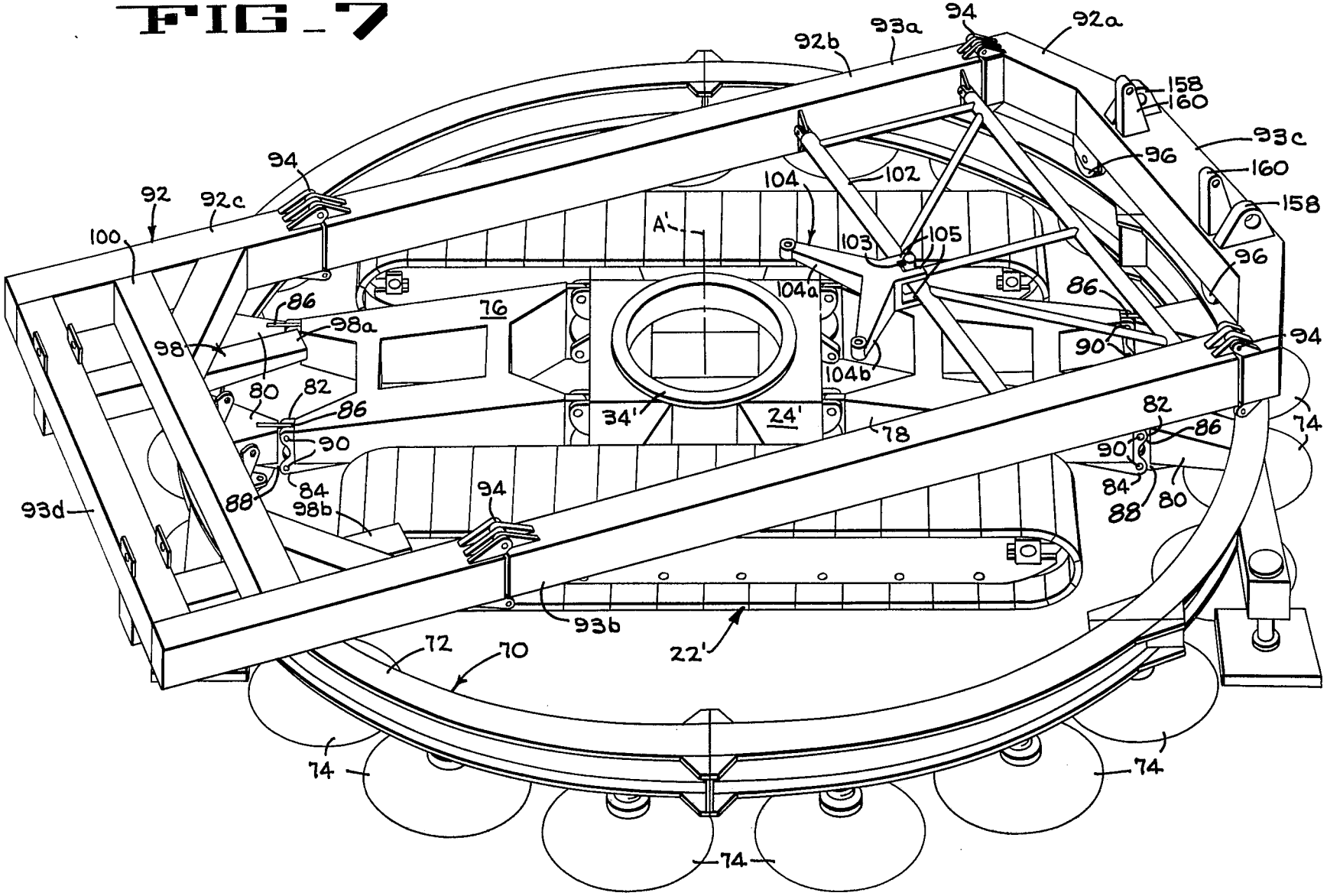
FIG. 7 is a fragmentary view (with parts omitted for clarity) similar to FIG. 6 but with the auxiliary frame added.

As shown in FIG. 7, a rectangular, auxiliary frame 92, consists of a forward portion 92*a*, a central portion 92*b*, and a rear portion 92*c*. The frame, as a unit, can be considered as having two parallel side members 93*a*, 93*b*, a front member 93*c* and a rear member 93*d*. The front and rear portions 92*a* and 92*c* are secured to central portion 92*b* as at 94, by intermeshing ears, on the top and bottom of the frame, and a horizontal pin through the ears to hold the portions together without significant pivotal motion, to form an unarticulated frame.

The auxiliary frame 92 has depending rollers 96, aligned tangentially with ring 70, which ride, at four points, on the upper surface 72 of the ring. At the rear of the auxiliary frame, there are two inwardly extending support arms 98*a*, 98*b*, and a support pad 98*c* (see FIG. 8) connected to cross beam 100. The arms 98*a*, 98*b* and pad 98*c* define a support shelf 98, the purpose of which will be described hereinafter. At the front of the auxiliary frame there is a truss 102, connected between the side members of the frame, with a fitting 104 extending inwardly therefrom. The fitting 104, for reasons which will become clear hereinafter, has four spaced fingers 105 to straddle a portion of truss 102 and also the vertical pin 103. The spacing of the fingers is such as to allow a small vertical movement between the fitting 104 and the truss 102.

Figure 8:
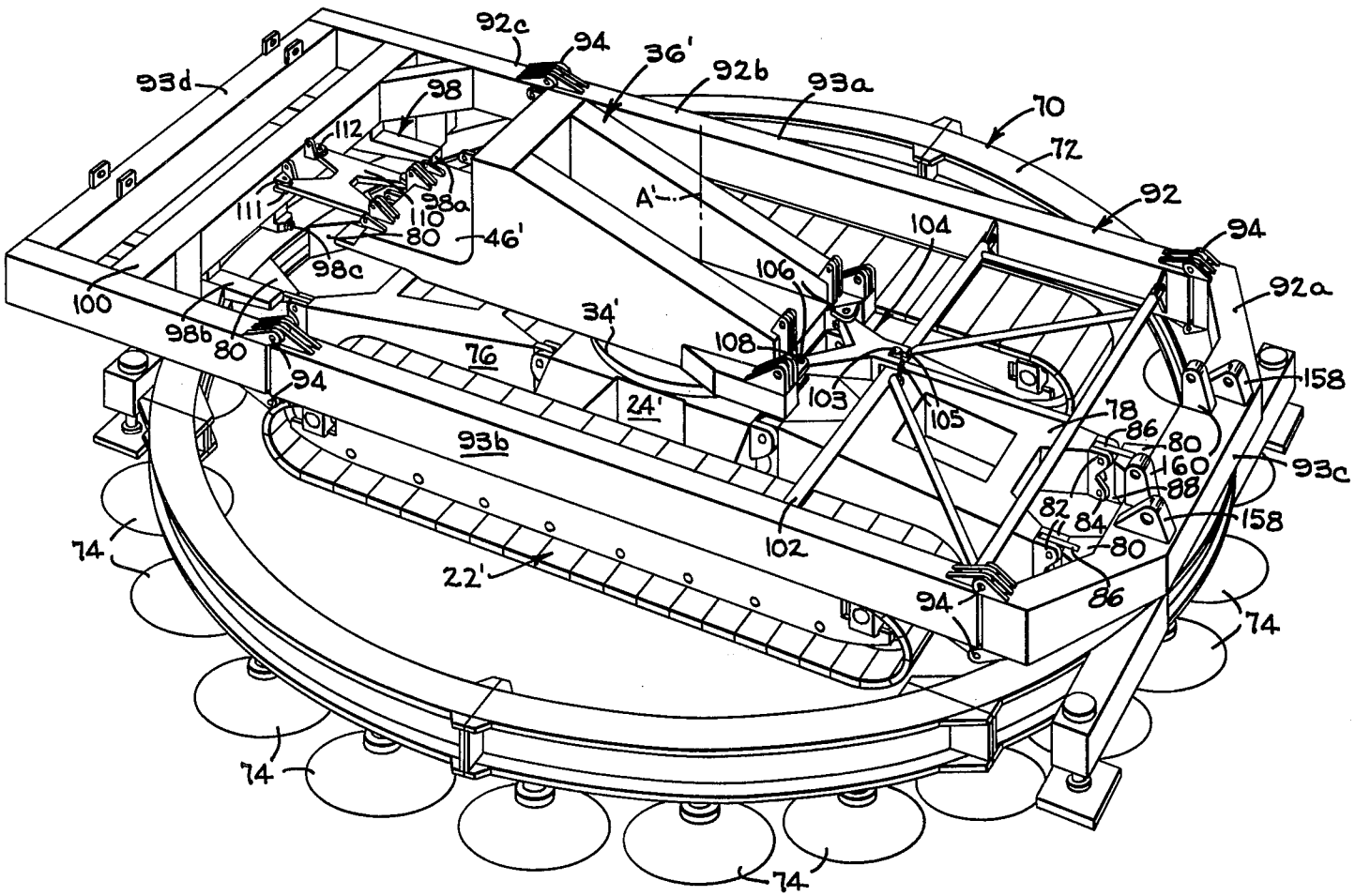
FIG. 8 is a fragmentary view (with parts omitted for clarity) similar to FIG. 7 but with the portions of upper works added.

As shown best in FIG. 8, the upper works 36' is received in the bearing 34' of the central base portion of the lower works 22 for rotation about the axis A'. Conventional power machinery, not shown, is provided to rotate the upper works with respect to the lower works. The auxiliary frame 92, which surrounds the upper works, is connected to the upper works, at the front and rear of the upper works, for rotation with the upper works. The axis A' of rotation of the upper works passes through the center of the ring 70, and the rollers 96 of the frame 92 are equi-spaced from the axis A', so that the auxiliary frame can rotate on the ring 70 through any angle the upper works is rotated. The frame 92 is connected to the forward end of the upper works through fitting 104, which has extending arms 104a, 104b received between ears 106 for pinning as at 108. The ears 106 are spaced apart sufficiently to allow a small amount of free vertical movement between the fitting 104 and the upper works. The rear end of the upper works 36' is connected to frame 92 by means of plate 110 which is received between the horizontally aligned ears 111 on these members and pinned as at 112. Again, the ears 111 are spaced apart sufficiently to allow a small free vertical movement between the plate 110 and the members to which it is connected. Thus, the upper works 36', and the auxiliary frame 92, rotate about axis A' in unison. Although the fitting 104 and plate 110 serve to connect the upper works 36' to the auxiliary frame 92 for the transmission of torque from the former to the latter without any play in a lateral direction between these members, there is sufficient vertical play at the connection of the fitting 104 and the plate 110 to these members to allow some small free vertical movement between the frame 92 and the upper works 36'.

Although the amount of vertical relative movement between the auxiliary frame 92 and the upper works 36' is small, it is important because it allows all the weight of the frame, and all the weight carried by the frame, to be transmitted directly to the ring 70 (and thence to the ground) without imposing any load on the upper works 36' or the bearing 34'.

Figure 9:
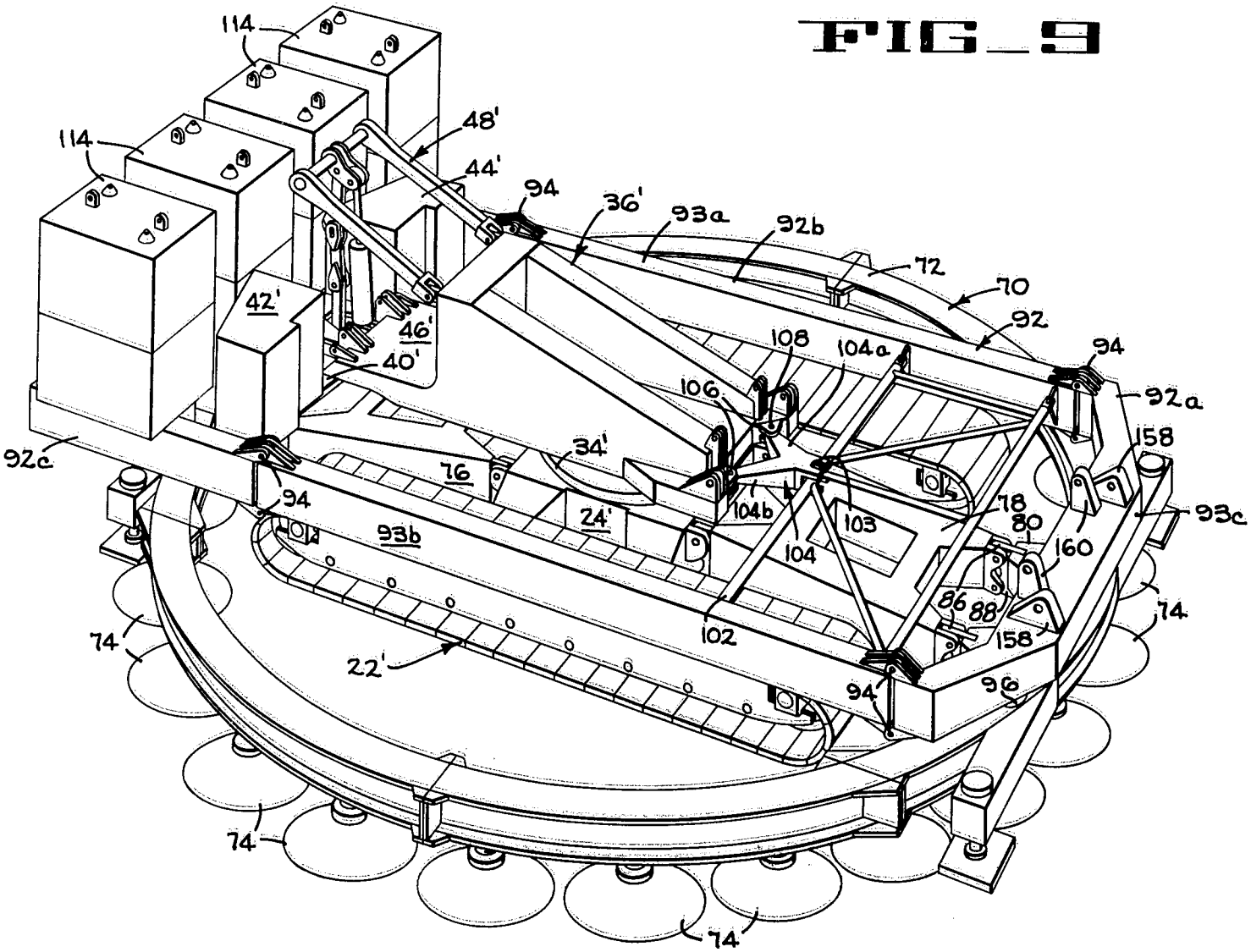
FIG. 9 is a fragmentary view (with parts omitted for clarity) similar to FIG. 8 but with all the counterweights added.

As shown best in FIG. 9, four auxiliary counterweight units 114 are mounted on the rear portion 92c of the auxiliary frame 92. The upper works counterweights 42' and 44' are mounted on plate 40' (see plate 40 of FIG. 1) which lies between the shelf 98 (defined by arms 98a, 98b and pad 98c) and the connecting plate 110. When the counterweights 42', 44' and plate 40' are used in the heavy duty mode, the plate 40' is lowered by the mechanism 48' from abutment against the underside of shelf 46' (of the upper works) to a position on shelf 98 (FIG. 8) where the entire weight of plate 40' and the counterweights 42', 44' is borne by the auxiliary frame. Thus, when the crane is used in the heavy duty mode, not only do the auxiliary counterweight units 114 lie directly on auxiliary frame 92, but also the regular counterweights 42', 44' and plate 40 as well.

The superstructure and rigging of the crane of FIG. 1 is shown in FIG. 2. The crane, when utilized for regular duty, has a boom 39 pivotally connected to brackets 38 at the front end of the upper works. A live mast 132 is pivotally connected to brackets 134 adjacent the brackets 38 on the upper works. A boom stop 136, to limit the rearward movement of the boom, is mounted on the upper works. Boom pendants 138 are secured at one end to the top of the boom 39 and at the other end to the top of the live mast 132. Boom hoist reeving 140 between the top of the live mast and the top of the upper works, when powered by a winch in the upper works, swings the live mast to raise the boom. A hoist, or load, line 146 has one end connected to a winch 148 in the upper works. The line passes over a sheave 150 at the top of the boom to a sheave block 152 having a load hook 154. The line 146 runs around the sheave in a block 152 and is secured to the top of the boom. A housing 142 for the upper works protects the machinery thereon and provides a cab 144 for the operator.

Figure 10:
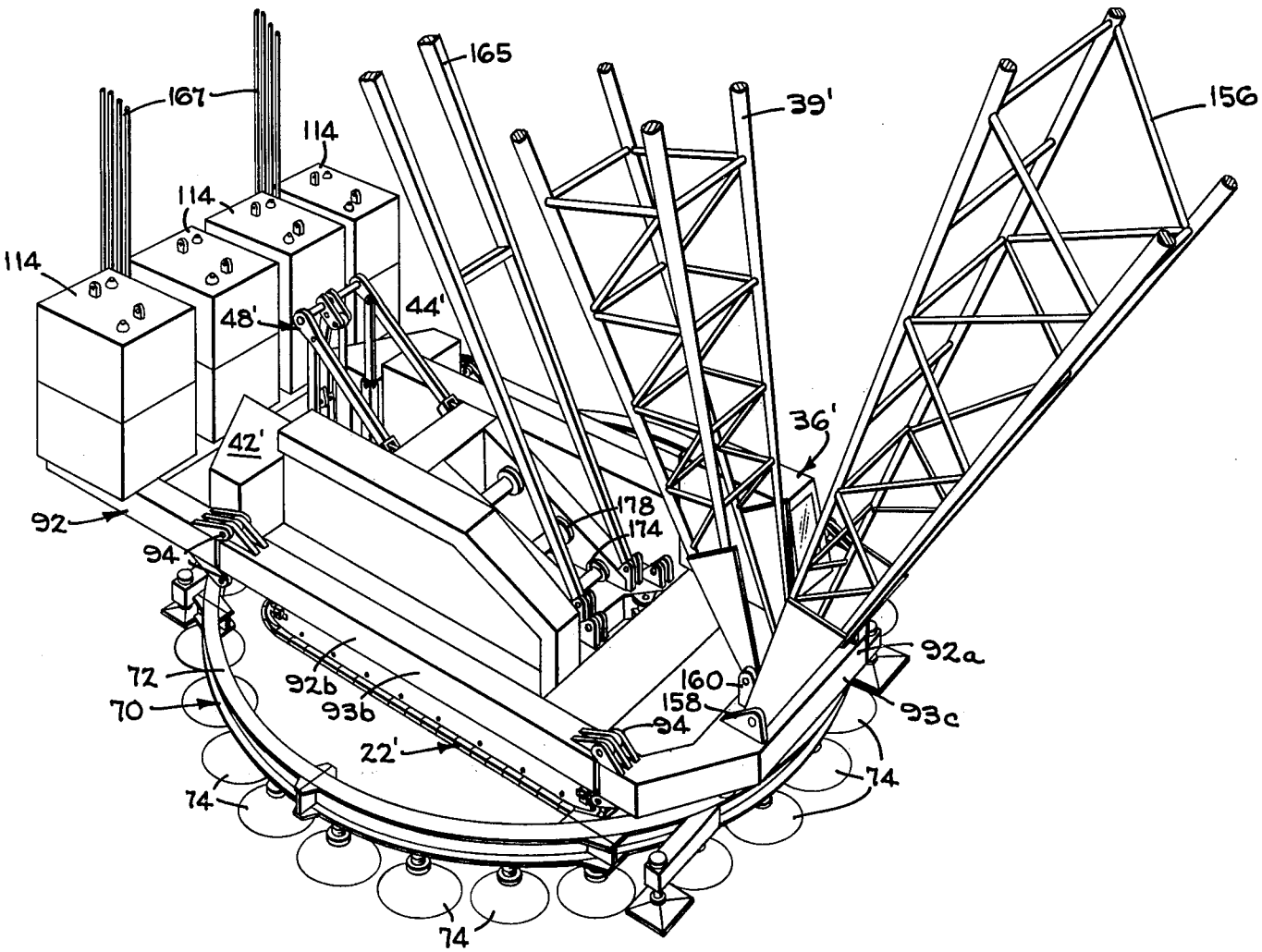
FIG. 10 is a fragmentary view (with parts omitted for clarity) similar to FIG. 9 but with the heavy duty boom, live mast and gantry added.

The superstructure and rigging for the crane when in the heavy duty mode is shown in FIGS. 5 and 10. In this mode of operation, a large boom 156 is pivotally connected to ears 158 on the forward end 92a of the auxiliary frame 92. A gantry 39' (which may be the boom 39 of the machine when used in the regular duty mode) is pivotally connected to ears 160 adjacent ears 158 on the frame 92.

The gantry 39' is held tightly against boom stop 162 (which is pivotally connected to the top of the upper works of the crane) by gantry pendants 164 connected between the top of the gantry and the top of the live mast 165, which is anchored to the auxiliary frame by lines 167. Boom hoist reeving 166 extends between the top of the boom 156 and the top of the gantry 39', and includes sheaves 168 and 170. A boom hoist line 172, which has one end connected to a winch 174 in the upper works, is received over the sheaves 168 and 170 and has the opposite end connected to the sheave 168. Operation of winch 174 permits the boom 156 to be lowered, and enables the boom to be raised to any desired position, including the extreme upper position shown in FIG. 5. A load, or hoist, line 176 has one end connected to winch 178 and has the opposite end secured to the top of boom 156. The line is received over a guide sheave 180 on gantry 39', a sheave 182 on the top of gantry 39', a sheave 184 on the top of boom 156, and a sheave in sheave block 186. A hook 188 is suspended from block 186 to receive the load.

Although the best mode contemplated for carrying out the present invention has been herein shown and described, it will be apparent that modification and variation may be made without departing from what is regarded to be the subject matter of the invention.

What is claimed is:

1. In a crane for lifting heavy loads, said crane having a lower works and having an upper works rotatably mounted on the lower works to pivot about an axis, a support track surrounding said lower works and supported from the ground, the improvement comprising a rigid auxiliary frame also pivotal about the axis and supported by the support track only, a boom pivotally mounted on one end of the auxiliary frame and a counterweight mounted on the opposite end of the auxiliary frame, and means connecting said upper works to the frame with vertical play between said connected members for pivoting movement of the frame about the axis with the upper works whereby said frame is mounted on the support track only.

2. The crane of claim 1 wherein said lower works has members on each side to propel the lower works in a forward or rearward direction, and wherein said support track is circular, said crane having trusses extending, respectively, in a forward and rearward direction from the lower works between said propelling members to link the circular track to the lower works in concentric relationship.

3. The crane of claim 1 including a counterweight on said upper works and means to shift said upper works counterweight to said auxiliary frame.

4. The crane of claim 1 including a mast mounted on the end of said frame on which said boom is mounted, means to hold said mast in a fixed position, and reeving connected between the mast and the boom to raise and lower the boom.

5. The crane of claim 1 wherein said support track is circular with a center on said axis, and wherein said frame has rollers at each end equally spaced from said axis to ride on said circular track.

6. The crane of claim 5 wherein the rear end of said frame overhangs the rollers at that end, and wherein the counterweight on said frame is mounted on the rear end overhang thereof.

7. In a heavy duty crane having a lower works and having an upper works rotatably received on the lower works, said upper works having a counterweight received thereon, said crane having a circular track surrounding said lower works and supported from the ground, the improvement comprising an unarticulated auxiliary frame mounted on said track, a boom pivotally connected to one end of said auxiliary frame, an auxiliary counterweight mounted on the opposite end of the auxiliary frame, and means to shift said upper works counterweight from said upper works to said auxiliary frame.

8. In a heavy duty crane having a lower works and having an upper works rotatably received on the lower works, said upper works having a counterweight thereon and having mechanism to lift the counterweight off the upper works, said crane having a circular track surrounding said lower works and supported from the ground, the improvement comprising an unarticulated auxiliary frame mounted on said track, a boom pivotally connected to one end of said auxiliary frame, an auxiliary counterweight mounted on the opposite end of the auxiliary frame, and means on the auxiliary frame to receive the upper works counterweight thereon.

9. In a heavy duty crane having a lower works and having an upper works mounted on the lower works for rotation about an axis, the upper works having a counterweight and having mechanism to move the counterweight off the upper works, said crane having a circular work surrounding said lower works and supported from the ground, the circular track having a center on said axis, the improvement comprising an unarticulated auxiliary frame connected to said upper works for a slight vertical movement relative thereto but for turning movement therewith about said axis, said auxiliary frame rectangular and surrounding the upper works, said frame having rollers at the front end and at the rear end of the frame equally spaced from said axis to ride on said circular track, the rear end of said frame overhanging the roller at that end, a load bearing boom pivotally mounted on the front end of said frame over the roller at that end, an auxiliary counterweight mounted on the rear overhang of said frame, and means on the frame radially inward from said auxiliary counterweight to receive the upper works counterweight.

10. In a heavy duty crane having a lower works and having an upper works mounted on the lower works for rotation about an axis, said upper works having a counterweight and said crane having a circular track connected to and surrounding said lower works, said track supported from the ground and having a center on said axis, the improvement comprising an unarticulated auxiliary frame connected to said upper works for free vertical movement relative thereto but for turning movement therewith about said axis, said auxiliary frame having rollers at each end equally spaced from said axis to ride on said circular track, a load bearing boom pivotally mounted to said auxiliary frame at one end adjacent said rollers, an auxiliary frame counterweight mounted at the other end of said auxiliary frame adjacent said rollers, and means on the auxiliary frame to receive the upper works counterweight when said counterweight is moved off the upper works.

* * * * *